72-135
10/15/85 OR 4,546,631

SR

United States Patent [19]

Eisinger

[11] Patent Number: 4,546,631

[45] Date of Patent: Oct. 15, 1985

[54] ROLLER MECHANISM FOR FORMING HELICAL SHAPES

[75] Inventor: Frantisek L. Eisinger, Demarest, N.J.

[73] Assignee: Foster Wheeler Energy Corporation, Livingston, N.J.

[21] Appl. No.: 701,440

[22] Filed: Feb. 12, 1985

Related U.S. Application Data

[63] Continuation of Ser. No. 481,135, Apr. 1, 1983, abandoned.

[51] Int. Cl.[4] ..... B21F 3/02

[52] U.S. Cl. ..... 72/135; 72/145

[58] Field of Search ..... 72/64, 65, 66, 95, 98, 72/100, 135, 137, 145, 160, 161, 164, 298, 371; 140/149

[56] References Cited

U.S. PATENT DOCUMENTS

| | | | |
|---|---|---|---|
| 1,835,198 | 12/1931 | Abramsen | 72/164 |
| 2,749,962 | 6/1956 | Kitselman | 72/145 |
| 2,769,478 | 11/1956 | Schane | 72/145 |
| 4,287,743 | 9/1981 | Hantschk | 72/98 |

FOREIGN PATENT DOCUMENTS

| | | | |
|---|---|---|---|
| 109266 | 11/1939 | Australia | 72/298 |
| 1235847 | 3/1967 | Fed. Rep. of Germany | 72/164 |
| 1014885 | 8/1952 | France | 72/135 |
| 57538 | 5/1946 | Netherlands | 72/135 |
| 756409 | 9/1956 | United Kingdom | 72/142 |
| 617113 | 7/1978 | U.S.S.R. | 72/371 |

*Primary Examiner*—E. Michael Combs
*Attorney, Agent, or Firm*—Marvin A. Naigur; John E. Wilson; Martin Smolowitz

[57] ABSTRACT

A roller mechanism and method for forming helical shaped structures from a feed wire or rod, wherein the feed wire is drawn through a plurality of staggered forming rollers by rotation of the rollers, while the wire is also being rotated about its own axis so as to form the desired helical shaped product. The mechanism includes a support frame and at least four lower fixed position driven rollers and at least five upper idler rollers having adjustable positions relative to the lower rollers rotatably mounted in the frame. The lower rollers usually have a roughened or grooved surface to facilitate drawing the feed wire through the staggered forming rollers. If desired, the feed wire can be pulled off a rotating supply reel by a pair of guiding rollers and then passed through the forming rollers to provide the desired helical shaped product.

12 Claims, 7 Drawing Figures

ROLLER MECHANISM FOR FORMING HELICAL SHAPES

This application is a continuation of application Ser. No. 481,135, filed Apr. 1, 1983, abandoned.

BACKGROUND OF INVENTION

This invention pertains to a roller mechanism and method used for forming helical shapes from wire or bar stock material using multiple parallel forming rollers. It pertains particularly to such a roller mechanism and method in which the feed wire is continuously drawn through the forming rollers while the wire is being rotated about its own longitudinal axis, so as to form helical shapes having various desired parameters of diameter and pitch.

Mechanisms for forming of helical shapes have been previously developed, as disclosed by U.S. Pat. No. 2,749,962 to Kitselman and U.S. Pat. No. 2,769,479 to Schane. However, in both these wire forming mechanisms the wire being formed is pushed by a feeding roller through rotating forming rollers, which can result in large compressive forces being developed in the wire and can cause undesired deformation and buckling of the wire, particularly for small diameter wires which are relatively flexible and prone to bending. Such wire instability problems when forming helical shapes are eliminated by the present invention, which instead advantageously draws the wire through multiple parallel forming rollers and utilizes small tensile forces developed in the wire being formed to provide a superior helical-shaped product.

SUMMARY OF INVENTION

The present invention provides a roller mechanism and method for continuously forming elongated helical shapes or structures from a wire or bar stock material, which material preferably has a circular cross-sectional shape. More specifically, the roller mechanism comprises a frame supporting a plurality of parallel aligned cylindrical shaped forming rollers, each roller being rotatably supported at one or both its ends by the frame and spaced relative to the other rollers in a staggered pattern, so as to form the wire feed into a desired helical shape as it is passed through the multiple rollers.

The rotatable forming rollers are provided in two rows or sets, comprising a first set of rotatable rollers which are fixed in their position in the mounting frame, and a mating second set of rollers which are transversely movable by frame adjustment means and are located in a staggered pattern relative to the fixed first set of rollers. The movable second set of rollers are preferably located above the fixed position first set of rollers and are vertically adjustable in position by an adjustable frame member, so as to control the outside diameter of the helical-shaped structure formed by the rollers.

The fixed first set of rollers are externally rotatably driven and are coupled together by a suitable drive means, such as chains or gears, so that the rollers each rotate at equal surface speeds. The movable position second set of rollers, which can be either idler or driven rollers, rotate in the opposite direction to the fixed position rollers, so that the two sets of forming rollers together serve to draw the feed wire through the rollers by friction between the driven rollers and the feed wire during its forming. The feed wire is also rotated about its own axis while being drawn through the forming rollers, so as to form the wire into a desired helical-shaped structure as the wire is passed through the forming rollers. If desired to provide more precisely formed helical shapes, additional adjustable secondary forming rollers can be provided downstream from and used in combination with the two sets of primary forming rollers. The spacing between the two rows or sets of forming rollers is progressively decreased for the succeeding rollers, so that the wire helical shape is progressively formed as it passes through the rollers.

The roller mechanism and method of this invention can be used for forming metal wires, rods, or tubes having outside diameters in a range of about 0.150 to 0.750 inches into helical-shaped structures which usually have an outside diameter of 1–3 inches, although larger size helixes having larger diameter wires could be similarly produced. The helical pitch of the structures formed will be equal to the roller spacing in each row or set of rollers, and will usually be in a range of about 0.75 to 3 inches.

It is an advantage of the present invention that the wire or rod being formed into a helical shape is drawn through the forming rollers by action of the rollers which are rotated by external drive means, thus combining the driving and forming action for the feed wire into a single roller mechanism. The resulting helical-shaped structural product is useful for spacer application, such as for tube spacers mounted between heat exchanger tubes.

DETAILED DESCRIPTION OF INVENTION

Figure 1:
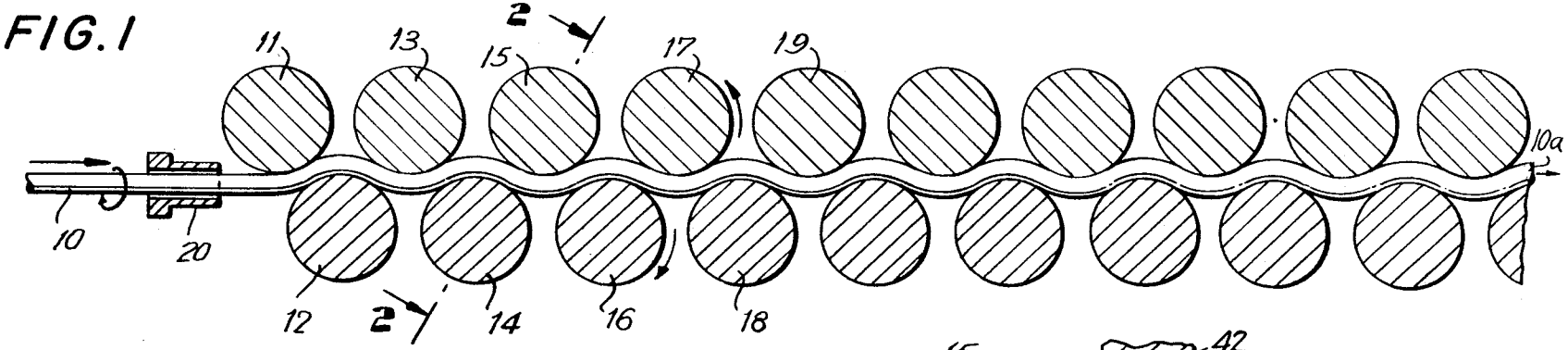
FIG. 1 shows a schematic elevation view of multiple forming roller rotatably mounted on parallel shafts and used for helically forming a feed wire in accordance with the invention.

The roller mechanism and method used in the invention for continuously forming helical shaped structures will now be described in greater detail by reference first to FIG. 1, which schematically shows a feed wire 10 being passed through a wire guide means 20 and then through a plurality of forming rollers arranged in a parallel staggered pattern. The rollers are each cylindrical shaped and are provided in two rows or sets, consisting of at least five vertically adjustable idler upper rollers 11, 13, 15, 17, and 19, and at least four lower fixed position driven rollers 12, 14, 16, and 18. The rollers are rotatably mounted in a support frame in a staggered pattern, with the upper rollers being positioned between the lower rollers. The lower rollers are each rotatably driven so as to draw the feed wire 10 through the staggered rollers due to the friction developed between these rollers and the wire. Thus, as the feed wire 10 is drawn through the rollers, the wire is progressively bent and formed into a sinusoidal pattern or shape. Also, as the wire 10 is drawn through the forming rollers, it is also rotated about its own axis so as to produce the helical shaped product emerging at 10*a*.

The number of rollers required for forming the helical shape is a function of the feed wire material and its forming characteristics, i.e., its elasticity and yield stress, and the wire diameter as well as the desired helix geometry and the friction developed between the driven rollers and the wire. Although the feed wire can have various cross-sectional shapes such as circular, hexagonal, or square, it is preferably circular shaped. For a particular number of lower driven rollers used, one additional upper roller should preferably be used each positioned between the adjacent lower rollers, so that two idler upper rollers are used above each driven lower roller for pushing downward on the wire being formed, thus developing sufficient friction between the driven lower rollers and the wire being formed to draw the wire through the rollers.

Usually only one row of forming rollers is driven by an external power source, preferably the bottom row, but the upper row of idler rollers could alternatively be driven. If both rows of rollers are driven, fewer rollers would be needed to perform the wire forming operation and provide the friction required for drawing the wire through the rollers.

For a given wire material and desired helix geometry, there is a minimum number of rollers needed. This number can be determined from theoretical consideration and/or based on experiments. In order to develop sufficient friction between the driven rollers and the formed feed wire, normally 10–12 driven rollers are required. Although a greater number of rollers can be used, from a practical point of view using too many rollers requires tight tolerances in locating the rollers since an accumulation of errors over a large number of rollers could lead to changes in the desired helix geometry. The practical maximum number of forming rollers is approximately 1.5 times the minimum number of rollers required to form the desired wire helix shape.

Figure 2:
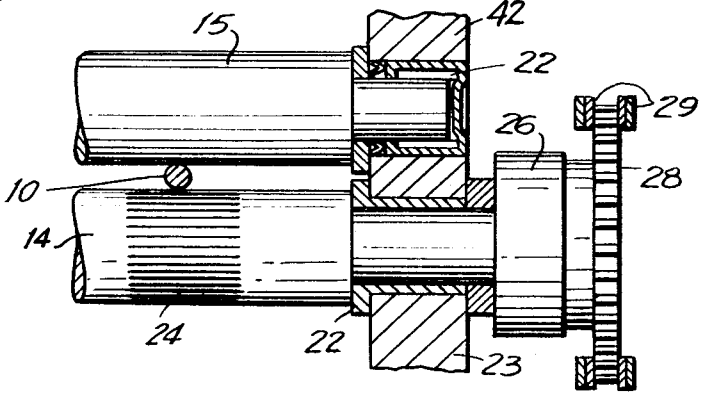
FIG. 2 shows a partial sectional view taken along section lines 2—2 of FIG. 1, with the wire positioned between the lower driven forming roller and the upper idler forming roller.
Figure 7:
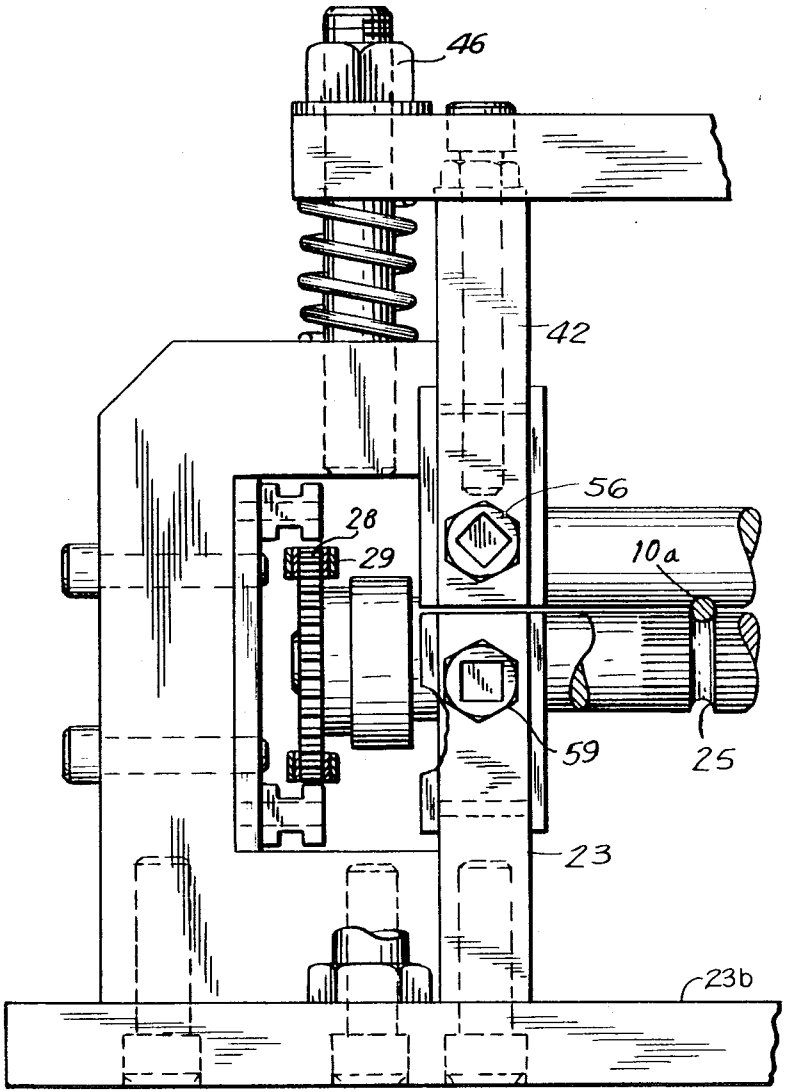
FIG. 7 shows an elevation sectional view taken along section lines 7—7 of FIG. 5.
Figure 6:
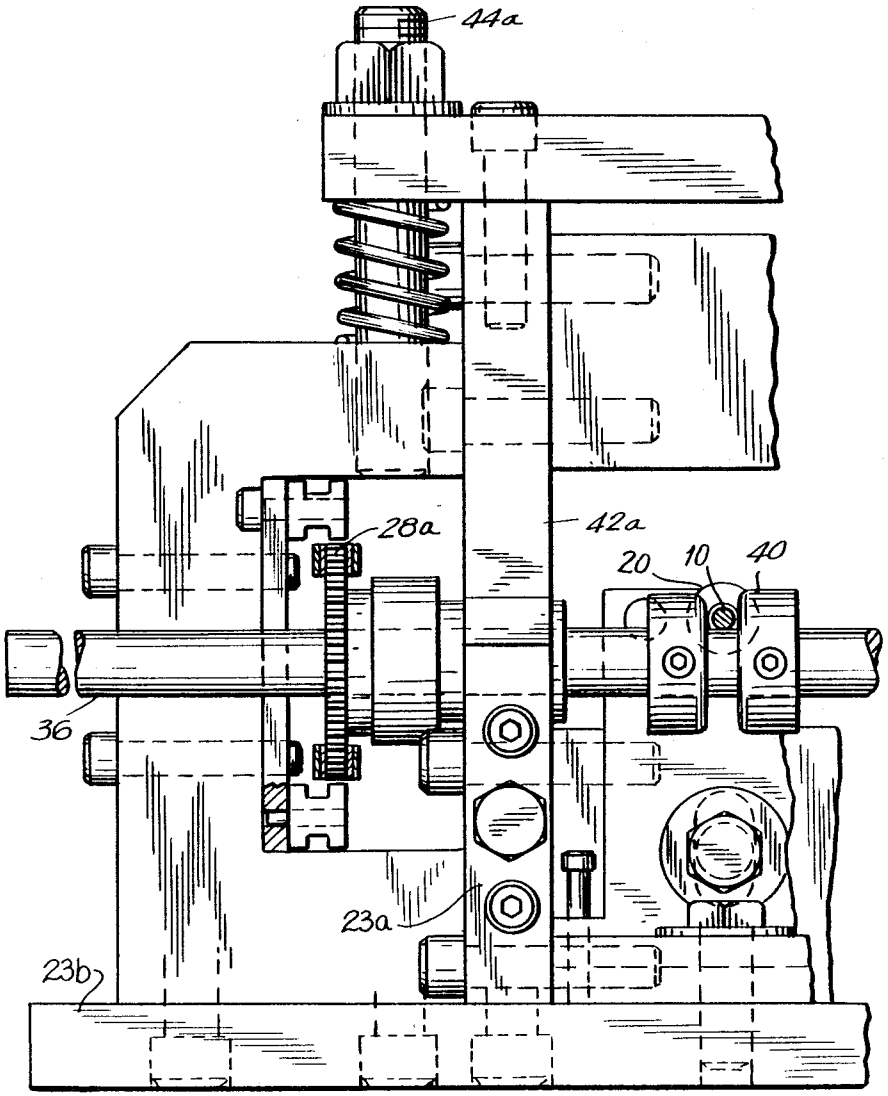
FIG. 6 shows an elevation sectional view taken along section lines 6—6 of FIG. 5.

As is typically shown in FIG. 2, the forming rollers for example 14, 15 are each rotatably mounted in suitable bearings 22 such as needle bearings, and supported in fixed frame member 23 and 42 located at one end of the roller and at the other end by parallel frame member 23*a*, 42*a*. The fixed position lower set of rollers are rotatably driven by an external drive means, and have roughened or knurled surfaces 24 which increase their gripping action on the wire 10. Alternatively, a groove 25 can be provided in each of the driven forming rollers into which the wire fits, as shown in FIG. 7. The groove is sized so as to aid in guiding and gripping the wire being formed by increasing the area of roller contact with the wire, and thereby increasing the friction forces between the wire and the driven roller. The fixed position lower rollers are each driven by shaft 26 and are coupled together either by meshing drive gears located between the adjacent lower rollers or by sprocket 28 and mating drive chain 29. The upper set of idler rollers 11, 13, 15, 17 and 19 can be moved vertically relative to the lower set of driven rollers 12, 14, 16 and 18 by suitable adjustment means, such as spring-loaded bolts as described hereinbelow. By this arrangement, the spacing between the two sets of rollers can be progressively decreased for the subsequent rollers, so that the wire is progressively bent and helically formed as it passes through the two sets of rollers.

The feed wire or rod 10 can be provided as long relatively straight pieces before forming. When a straight wire is fed into the forming machine, only guide means are needed for supporting the straight wire, since its rotation about its own axis is provided by action of the forming rollers themselves. A helical die (not shown) which serves as a leader for pulling the straight wire or bar through the forming rollers is rigidly attached and is usually welded to the feed end of the wire before forming. A cut-off means (not shown) for the helical shaped product can be provided after the last roller, and can be made a part of the wire forming machine.

Figure 3:
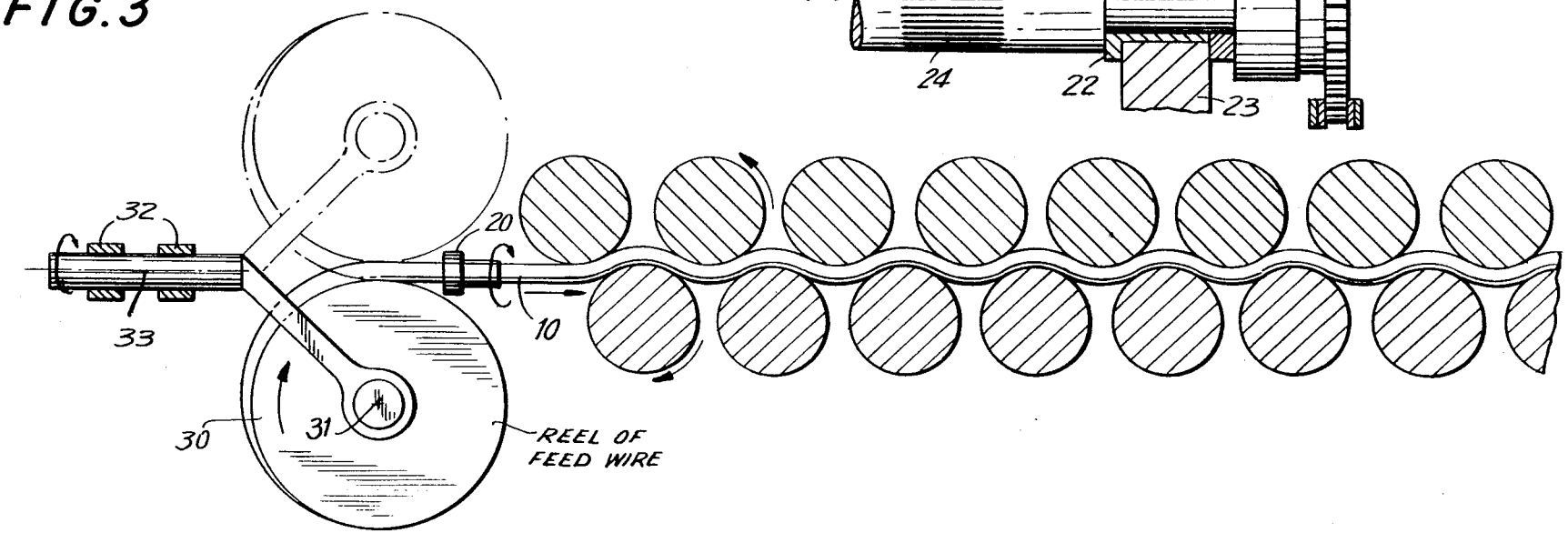
FIG. 3 is a schematic view of the invention showing multiple forming rollers for the feed wire and means for also rotating the wire about its own axis so as to form a helical shape.

If it is desired to continuously form long helical-shaped products, the feed wire 10 can be preferably provided from a rotatable reel 30, as is functionally shown in FIG. 3. The supply reel 30 is retained in a holding device 32 and is rotated about the reel center axis 31, while the reel 30 is also being rotated about axis 33 of the reel holding device 32, which is positioned substantially parallel to the longitudinal axis of the feed wire 10 as it is fed into the forming rollers. The rotation of wire reel 30 and holding device 32 about mounting axis 33 is produced in a conventional manner by a drive motor and variable speed gear reducer (not shown) connected to the reel support device 32. Although FIG. 3 shows the correct functional relationships between reel 30 and holder 32, if it is desired to use a larger diameter supply reel so as to contain a larger quantity of feed wire, reel 30 could be supported by bearings 32 located on opposite sides of reel 30 and arranged so that axis 33 passes more nearly through the center of the reel 30. The rate of rotation of the wire reel 30 about longitudinal axis 33 must be related to the rate of rotation of the forming rollers, so as to produce the desired helical-shaped structure. Although either chain drive or gear drives for the rollers can be used, the chain drive is simpler to accomplish and is usually preferred. The choice of which type drive to use will depend on the desired roller spacing, torques, and forces transmitted. Although the shaft power can be applied to the driven rollers at any point, it is preferably applied directly to the first roller 12 because there the greatest forming action on the wire occurs.

Figure 4:
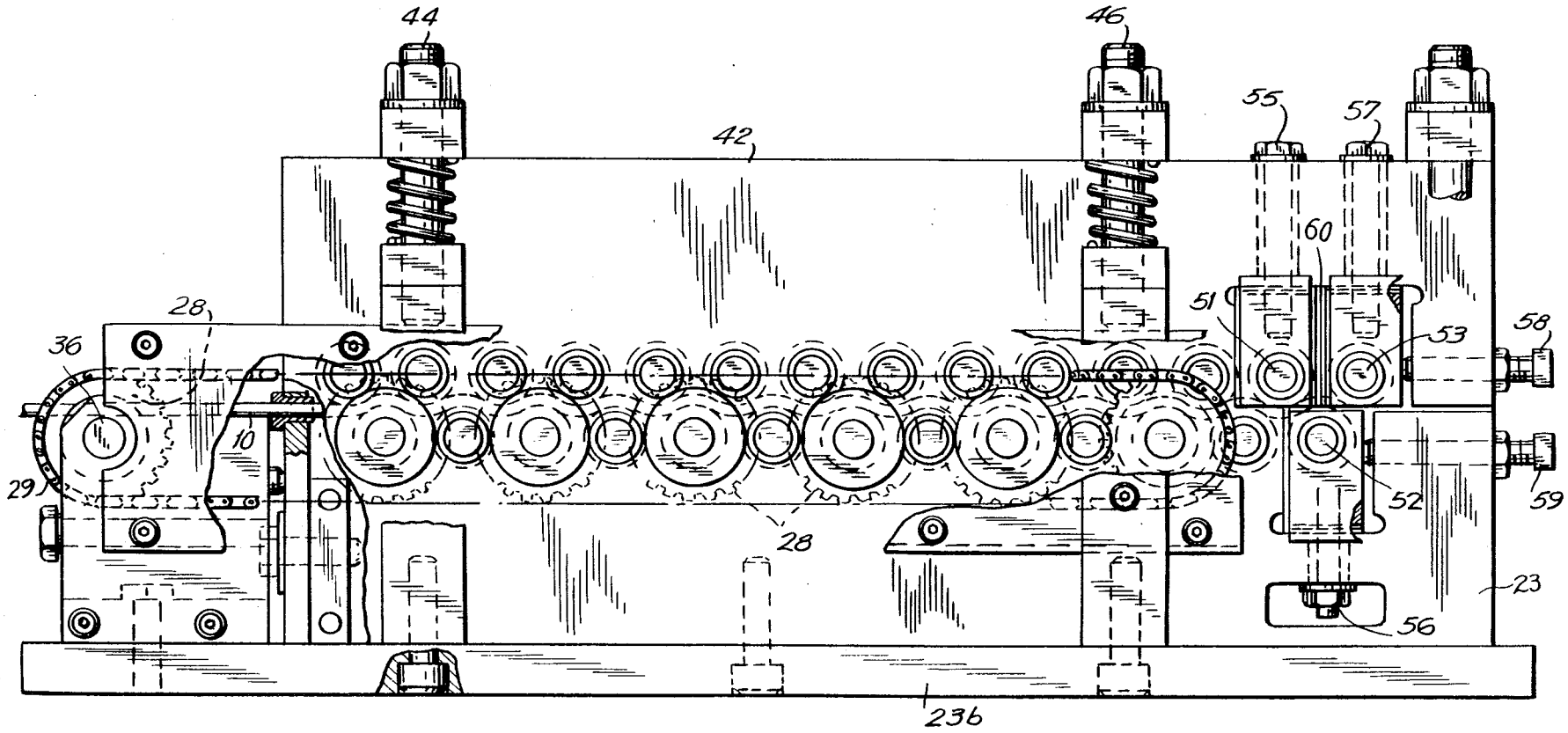
FIG. 4 shows a side elevation view of the roller mechanism assembly for forming helical wire shapes.
Figure 5:
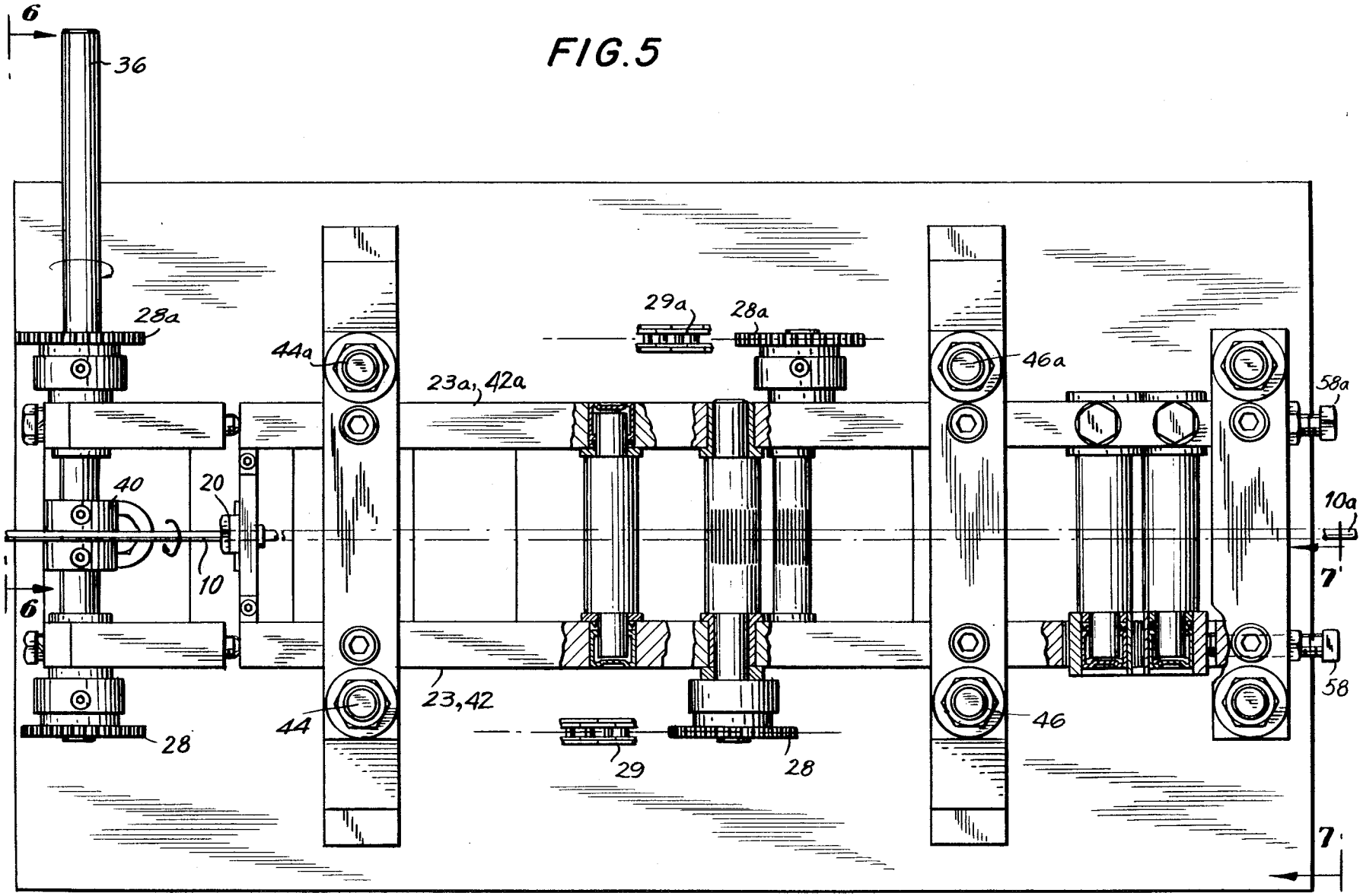
FIG. 5 shows a plan view of the roller mechanism of FIG. 4.

As shown in FIG. 2 and also shown in greater detail in the FIG. 4 side elevation view of the roller mechanism, the lower fixed set of forming rollers are rotatably supported in lower frame member 23 which is rigidly attached to base member 23*b*, and can be driven by sprocket gears 28 which are coupled together by a suitable drive chain 29 such as a roller type chain and which is rotatably driven from the drive shaft 36. As is shown more clearly in the FIG. 5 plan view, the multiple lower forming rollers are each driven at their opposite ends, i.e. sprocket gears 28*a* and drive chain 29*a* are also provided at the opposite side of the roller mechanism adjacent frame member 23*a*. Also, located on drive shaft 36 is a rotary guide means 40, which is provided for guiding the wire 10 from the supply reel 30 into the first mating forming rollers 11, 12. The forming rollers should be made relatively short to minimize their deflection from the forces acting upon them during forming of the wire helix shape, and it is preferable to support the rollers at each end. Alternatively, a cantilevered arrangement of the rollers with the bearings located on one end only can be used with short rollers (not shown), however, the length of the rollers used should usually be somewhat greater than the outside diameter of the helix being formed.

The upper set of forming rollers are arranged to be vertically adjustable relative to the positions of the lower set of rollers within frame members 23 and 23*a*. Such vertical adjustment is accomplished by the upper rollers being rotatably mounted in upper side members or plates 42 and 42*a*, which are each movable in the vertical direction and held in a desired position by spring-loaded bolts 44 and 46.

As also shown in FIG. 4, at least three auxiliary forming rollers 51, 52, and 53 are provided in the support frame at the outlet end of the roller mechanism for accomplishing any final sizing required for the helical shape being formed. These rollers can be moved in both the horizontal and vertical directions by means of vertical lockable adjusting bolts 55, 56, and 57, horizontal lockable adjusting bolts 58, and 59, and spacer shims 60.

The invention will be further described in terms of the following example, which should not be construed as limiting in scope.

EXAMPLE

A steel wire having diameter of 0.250 inch was fed into a roller forming mechanism having nine upper idler rollers and eight lower rollers driven by a chain drive from a rotating drive shaft. The rollers were arranged in a staggered pattern and were rotatably supported at each end in a frame having parallel members. The driven lower rollers each had knurled surfaces so as to increase friction between the rollers and the wire being formed. The feed wire was rotated about its own axis while being passed through the roller mechanism, which resulted in a helical shaped structure being formed having an outside diameter of about 1.5 inches emerging from the roller forming mechanism.

Although this invention has been disclosed broadly and in terms of a preferred embodiment, it is understood that other variations and modifications can be made to the roller mechanism and method of use within the spirit and scope of the invention, which is defined by the following claims.

I claim:

1. A roller mechanism for forming elongated helical-shaped structures using multiple forming rollers, comprising:

(a) a support frame having a fixed member and an adjustable member, each member being provided with means for rotatably supporting parallel multiple rollers;

(b) at least nine parallel cylindrical forming rollers spaced apart from each other and rotatably mounted in said support frame and arranged in a vertically non-aligned or staggered pattern in two sets, four rollers in a first set being rotatably mounted in said frame fixed member and rotatably driven and five rollers in a second set being adjustable relative to the first set for drawing a feed wire through the multiple rotating staggered forming rollers solely by a frictional drawing force exerted on the wire by said sets of forming rollers, and thereby form the wire passing through the rollers into a sinusoidal pattern;

(c) drive means coupling together all said driven rollers of said first set so as to rotate said driven rollers at a common surface speed; and (d) means for rotating the feed wire about its own axis while being drawn through said forming rollers, so as to produce a helical shaped structural product.

2. The forming roller mechanism of claim 1, wherein one of said two rollers sets contain at least four fixed position driven rollers and the other said set contains at least five idler rollers located above the fixed position rollers; the position of said idler roller set being adjustable relative to the fixed position roller set in said support frame, so as to control the spacing between the two roller sets and thereby control the diameter of the formed helical shaped wire product.

3. The forming roller mechanism of claim 1, wherein a guide means is provided attached to said frame for guiding the feed wire to the first forming rollers.

4. The forming roller mechanism of claim 2, wherein the driven set of rollers have roughened surfaces to provide increased friction between the rollers and a feed wire sufficient for pulling the feed wire through said driven rollers.

5. The forming roller mechanism of claim 2, wherein the driven set of rollers each have a groove into which a feed wire being formed is fitted, so as to increase the surface contact and friction betweenn the driven rollers and the wire.

6. The forming roller mechanism of claim 1, wherein three supplemental rollers each adjustable in position are provided in a staggered arrangement in said frame to produce more precise forming of the helical shaped product.

7. The forming roller mechanism of claim 2, wherein said driven rollers are each rotatably driven from a common rotatable shaft by drive chain means connecting said rollers together so that said rollers rotate at common surface speed.

8. The forming roller mechanism of claim 2, wherein said driven rollers are each driven at a common surface speed by gears located between the rollers.

9. The forming roller mechanism of claim 2, wherein the vertical adjustment spacing between the roller sets is progressively decreased for the subsequent rollers.

10. The forming roller mechanism of claim 1, including a supply reel unit for a feed wire, wherein the feed wire is unrolled from the supply reel rotatable about the axis of the reel, and wherein the supply reel unit is simultaneously rotatable about the longitudinal axis of the feed wire.

11. The forming roller mechanism of claim 1, wherein for a straight feed wire said means for rotation of said wire is a helical shaped die which initially pulls the wire through the sets of fixed position driven rollers and adjustable idler rollers.

12. A roller mechanism for forming elongated helical-shaped structures using multiple forming rollers, comprising:

(a) a support frame having a fixed lower member and an adjustable upper member, each member being provided with means for receiving parallel multiple rollers;

(b) at least four fixed position driven parallel rollers spaced apart from each other and rotatably mounted in said lower frame member, and at least five idler parallel rollers spaced apart from each other and mounted in said adjustable upper frame member in a vertically non-aligned or staggered relationship relative to said driven rollers; wherein the vertical adjustment between the roller sets is progressively decreased for the succeeding rollers, said lower rollers being rotatably driven for drawing a feed wire through the multiple rotating mating staggered forming rollers solely by a frictional drawing force exerted on the wire by said multiple forming rollers, and thereby form the wire passed through the rollers into a sinusoidal pattern;

(c) drive means coupling together all said driven rollers so as to rotate said driven rollers at a common surface speed; and (d) means for rotating the feed wire about its own axis while being drawn through said forming rollers, so as to produce a helical-shaped structural product.

* * * * *